US005883069A

United States Patent [19]

Childs et al.

[11] Patent Number: 5,883,069

[45] **Date of Patent: *Mar. 16, 1999**

[54] DRYER-ACTIVATED FABRIC CONDITIONING ARTICLES WITH IMPROVED SUBSTRATE

[75] Inventors: Stephen Lee Childs; Michael Allen Hoyle, both of Cincinnati, Ohio; Dale Alan Watts, Brockville, Canada; Alvin Michael Robertson, West Chester, Ohio; Alessandro Corona, III, Maineville, Ohio; Karl Joseph Russ, West Chester, Ohio

[73] Assignee: The Procter & Gamble Company, Cincinnati, Ohio

[ * ] Notice: The term of this patent shall not extend beyond the expiration date of Pat. No. 5,470,492.

[21] Appl. No.: 641,970

[22] Filed: May 2, 1996

[51] Int. Cl.[6] ..... D06M 23/02; D06M 13/46

[52] U.S. Cl. ..... 510/520; 510/521; 510/504; 510/499; 510/491

[58] Field of Search ..... 510/520, 521, 510/504, 499, 491

[56] References Cited

U.S. PATENT DOCUMENTS

| | | | |
|---|---|---|---|
| 4,110,498 | 8/1978 | Benjamin et al. | 428/35 |
| 4,137,180 | 1/1979 | Naik et al. | 252/8.8 |
| 4,237,155 | 12/1980 | Kardouche | 427/242 |
| 4,965,100 | 10/1990 | Leigh et al. | 427/242 |
| 5,139,687 | 8/1992 | Borgher, Sr. et al. | 252/8.6 |
| 5,300,238 | 4/1994 | Lin et al. | 252/8.6 |
| 5,376,287 | 12/1994 | Borcher, Sr. et al. | 252/8.8 |
| 5,470,492 | 11/1995 | Childs et al. | 252/8.6 |
| 5,474,691 | 12/1995 | Severns | 252/8.9 |
| 5,476,599 | 12/1995 | Rusche et al. | 252/8.8 |
| 5,503,756 | 4/1996 | Corona, III et al. | 252/8.8 |

*Primary Examiner*—Mark Kopec
*Assistant Examiner*—Charles Boyer
*Attorney, Agent, or Firm*—Robert B. Aylor

[57] ABSTRACT

Dryer-activated fabric softening articles having improved spun-bonded polyester substrates having improved feel characteristics and increased thickness as compared to conventional polyester substrates and/or feel characteristics that are not significantly different from conventional rayon substrates, after use in an automatic clothes dryer, said articles comprising:

(A) at least about 5% fabric conditioning composition comprising fabric conditioning active; and (B) a polyester non-woven fabric substrate prepared from a polyester fiber having a denier of from 5 to about 8, preferably from 5 to about 7, and more preferably about 6, said substrate having a basis weight of from about 0.53 oz/yd$^2$ to about 0.59 oz/yd$^2$, a thickness of from about 0.16 mm to about 0.23 mm, and, preferably, a tear strength of at least about 3 lbs/in$^2$, preferably from about 4 to about 7 lbs/in$^2$ in the cross direction and from about 3.1 to about 6 lbs/in$^2$ in the machine direction, and "belt fuzz" and "jet fuzz" grades, as described herein, of from about 1.8 to about 2.9, preferably from about 2 to about 2.7, more preferably from about 2.2 to about 2.5, said polyester having improved loft as compared to a similar polyester substrate prepared from 4 denier fiber.

12 Claims, No Drawings

DRYER-ACTIVATED FABRIC CONDITIONING ARTICLES WITH IMPROVED SUBSTRATE

TECHNICAL FIELD

The present invention relates to an improvement in dryer activated, e.g., dryer-added, softening products. These products are prepared by attaching compositions to a substrate.

SUMMARY OF THE INVENTION

The present invention relates to dryer-activated fabric softening articles comprising improved polyester substrates for use in an automatic clothes dryer. These articles comprise:

(A) at least about 5%, preferably from about 10% to about 90%, more preferably from about 10% to about 75%, and even more preferably from about 15% to about 55%, of fabric conditioning composition comprising fabric conditioning active and (B) a polyester non-woven fabric substrate prepared from a polyester fiber having a denier of from 5 to about 8, preferably from 5 to about 7, and more preferably about 6, said substrate having a basis weight of from about 0.53 oz/yd$^2$ to about 0.59 oz/yd$^2$, preferably from about 0.54 oz/yd$^2$ to about 0.58 oz/yd$^2$, more preferably from about 0.55 oz/yd$^2$ to about 0.57 oz/yd$^2$, and a thickness of from about 0.16 mm to about 0.23 mm, preferably from about 0.17 mm to about 0.22 mm, more preferably from about 0.19 mm to about 0.21 mm, and "belt fuzz" and "jet fuzz" grades, as described hereinafter, of from about 1.8 to about 2.9, preferably from about 2 to about 2.8, more preferably from about 2.2 to about 2.5, and, preferably, a tear strength of at least about 3 lbs/in$^2$ in both the cross direction and the machine direction, preferably from about 4 to about 7 lbs/in$^2$ in the cross direction and from about 3.1 to about 6 lbs/in$^2$ in the machine direction, said polyester having improved loft as compared to a similar polyester substrate prepared from 4 denier fiber.

The amount of (A) present is at least sufficient to provide improved fabric characteristics.

DETAILED DESCRIPTION OF THE INVENTION

The present invention relates to dryer-added fabric softening articles comprising substrates with improved feel after use, for use in an automatic clothes dryer. It has been discovered that substrates prepared from polyester fiber having a denier of from greater than 4 to about 8 provide articles having more void volume and loft, while preserving the same basis weight, than substrates prepared using lower deniers preferred in the prior art. The improved articles herein comprise:

(A) at least about 5%, preferably from about 10% to about 90%, more preferably from about 10% to about 75%, and even more preferably from about 15% to about 55%, of fabric conditioning composition comprising fabric conditioning active; and (B) a polyester non-woven fabric substrate prepared from a polyester fiber having a denier of from 5 to about 8, preferably from 5 to about 7, and more preferably about 6, said substrate having a basis weight of from about 0.53 oz/yd$^2$ to about 0.59 oz/yd$^2$, preferably from about 0.54 oz/yd$^2$ to about 0.58 oz/yd$^2$, more preferably from about 0.55 oz/yd$^2$ to about 0.57 oz/yd$^2$, and a thickness of from about 0.16 mm to about 0.23 mm, preferably from about 0.17 mm to about 0.22 mm, more preferably from about 0.19 mm to about 0.21 mm, and "belt fuzz" and "jet fuzz" grades, as described hereinafter, of from about 1.8 to about 2.9, preferably from about 2 to about 2.8, more preferably from about 2.2 to about 2.5, and, preferably, a tear strength of at least about 3 lbs/in$^2$ in both the cross direction and the machine direction, preferably from about 4 to about 7 lbs/in$^2$ in the cross direction and from about 3.1 to about 6 lbs/in$^2$ in the machine direction, said polyester having improved loft as compared to a similar polyester substrate prepared from 4 denier fiber.

When a substrate with a better feel is prepared by decreasing the heat and pressure to limit the amount of bonding, the strength of the substrate actually increases. Therefore, this option for improving feel is a preferred embodiment. The feel can also be improved by increased plasticizer usage and/or applying a softener to the surface of the substrate, especially in combination with, or after, application of a soil release polymer. The invention comprises articles comprising spun-bonded polyester substrates having improved feel after use, regardless of the approach taken. The "fuzz grades" measure correctly predicts the softness of the substrate after use. Substrates with the preferred fuzz grades actually get softer after use, while substrates with the fuzz grades representative of the prior art substrates do not get softer.

The active components can contain unsaturation for additional antistatic benefits. The components are selected so that the resulting fabric treatment composition has a melting point above about 38° C. and is flowable at dryer operating temperatures.

(A) The Fabric Conditioning Composition

The fabric conditioning composition can be any of those known in the art and/or previously disclosed by others in patent applications. Compositions that are suitable are disclosed in U.S. Pat. Nos.: 3,944,694, McQueary; 4,073,996, Bedenk et al.; 4,237,155, Kardouche; 4,711,730, Gosselink et al.; 4,749,596, Evans et al.; 4,808,086, Evans et al.; 4,818,569, Trinh et al.; 4,877,896, Maldonado et al.; 4,976,879, Maldonado et al.; 5,041,230, Borcher, Sr. et al.; 5,094,761, Trinh et al.; 5,102,564, Gardlik et al.; and 5,234,610, Gardlik et al., all of said patents being incorporated herein by reference.

Compositions of the present invention can contain from 0% to about 90%, preferably from 0% to about 80%, more preferably from 10% to about 70%, and even more preferably from about 20% to about 65%, of quaternary ammonium compound, preferably ester, and/or amide linked.

The quaternary ammonium compounds are typically of the Formulas I, II, and mixtures thereof Formula I comprises:

$$(R)_{4-m}—N^{(+)}-[(CH_2)_N—(Y)_p—R^2]_m\ X^{(-)}$$

wherein each Y=—O—(O)C—, —N(R)$^3$—C(O)—, —C(O)—N(R)$^3$—, or —C(O)—O—; m=1 to 3; n=1 to 4; p=0 or 1; each R substituent is a short chain $C_1$–$C_6$, preferably $C_1$–$C_3$, alkyl or hydroxy alkyl group, e.g., methyl (most preferred), ethyl, hydroxyethyl, propyl, and the like, benzyl and mixtures thereof, each $R^2$ is a long chain, saturated and/or unsaturated (Iodine Value—"IV" of from about 3 to about 60), $C_8$–$C_{30}$ hydrocarbyl, or substituted hydrocarbyl substituent and mixtures thereof; $R^3$ is R or H; and the counterion, $X^{(-)}$, can be any softener-compatible anion, for example, methylsulfate, ethylsulfate, chloride, bromide, formate, sulfate, lactate, nitrate and the like, preferably methylsulfate.

It will be understood that substituents R and $R^2$ of Formula I can optionally be substituted with various groups such as alkoxyl or hydroxyl groups.

The preferred ester linked compounds (DEQA) can be considered to be diester variations of ditallow dimethyl ammonium chloride (DTDMAC), which is a widely used fabric softener. Preferably, at least 80% of the DEQA is in the diester form, and from 0% to about 20%, preferably less than about 10%, more preferably less than about 5%, can be DEQA monoester (e.g., only one —Y—$R^2$ group). For optimal antistatic benefit monoester should be low, preferably less than about 2.5%. The level of monoester can be controlled in the manufacturing of the DEQA.

The quaternary softening compounds with at least partially unsaturated alkyl or acyl groups have advantages (i.e., antistatic benefits) and are highly acceptable for consumer products when certain conditions are met. Antistatic effects are especially important where the fabrics are dried in a tumble dryer, and/or where synthetic materials that generate static are used. Any reference to IV values hereinafter refers to IV of fatty alkyl or acyl groups and not to the resulting quaternary, e.g., DEQA compound. As the IV is raised, there is a potential for odor problems.

For unsaturated softener actives, the optimum storage temperature for stability and fluidity depends on the specific IV of, e.g., the fatty acid used to make DEQA and/or the level/type of solvent selected. Exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of DEQA Formula I (wherein all long-chain alkyl substituents are straight-chain):

Saturated $[C_2H_5]_2{}^{(+)}N[CH_2CH_2OC(O)C_{17}H_{35}]_2\ SO_4CH_3{}^{(-)}$ $[C_3H_7][C_2H_5]^{(+)}N[CH_2CH_2OC(O)C_{11}H_{23}]_2\ SO_4{}^{(-)}CH_3$ $[CH_3]_2{}^{(+)}N[CH_2CH_2OC(O)R^2]_2\ SO_4CH_3{}^{(-)}$ where —C(O)$R^2$ is derived from saturated tallow.

Unsaturated $[CH_3]_2{}^{(+)}N[CH_2CH_2OC(O)C_{17}H_{33}]_2\ SO_4{}^{(-)}CH_3$ $[C_2H_5]_2{}^{(+)}N[CH_2CH_2OC(O)C_{17}H_{33}]_2\ Cl^{(-)}$ $[CH_2CH_2OH][CH_3]^{(+)}N[CH_2CH_2OC(O)R^2]_2\ CH_3SO_4{}^{(-)}$ $[CH_3]_2{}^{(+)}N[CH_2CH_2OC(O)R^2]_2\ CH_3SO_4{}^{(-)}$ where —C(O)$R^2$ is derived from partially hydrogenated tallow or modified tallow having the characteristics set forth herein.

In addition to Formula I compounds, the compositions and articles of the present invention comprise DEQA compounds of Formula II:

$$N^{(+)}(R^1)_3—(CH_2)_N—CH(Q—T^1)—CH_2(Q—T^2)\ X^{(-)}$$

wherein, for any molecule:

each Q is —O—C(O)— or —(O)C—O—;

each $R^1$ is $C_1$–$C_4$ alkyl or hydroxy alkyl;

each $T^1$ and $T^2$ is a $C_8$–$C_{30}$ alkyl or alkenyl group;

n is an integer from 1 to 4; and $X^{(-)}$ is a softener-compatible anion; and wherein preferably $R^1$ is a methyl group, n is 1, Q is —O—C(O)—, $T^1$ and $T^2$ are $C_{14}$–$C_{18}$, and $X^{(-)}$ is methyl sulfate.

The straight or branched alkyl or alkenyl chains, $T^1$ and $T^2$, have from about 8 to about 30 carbon atoms, preferably from about 14 to about 18 carbon atoms, more preferably straight chains having from about 14 to about 18 carbon atoms.

These compounds can be prepared by standard esterification and quaternization reactions, using readily available starting materials. General methods for preparation are disclosed in U.S. Pat. No. 4,137,180, incorporated herein by reference.

The composition can also contain a ethoxylated and/or propoxylated sugar derivative contains a "sugar" moiety, e.g., a moiety derived from, e.g., a polyhydroxy sugar, or sugar alcohol, that contains from about 4 to about 12 hydroxy groups. This sugar moiety is substituted by at least one long hydrophobic group, containing from about 8 to about 30 carbon atoms, preferably from about 16 to about 18 carbon atoms. For improved physical characteristics, e.g., higher melting point, the hydrophobic group can contain more carbon atoms, e.g., 20–22, and/or there can be more than one hydrophobic group, preferably two or, less preferably, three. In general, it is preferred that the hydrophobic group is supplied by esterifying one of the hydroxy groups with a fatty acid. However, the hydrophobic group can be supplied by esterifying the hydroxy group to connect the hydrophobic group to the sugar moiety by an ether linkage, and/or a moiety containing a carboxy group esterified with a fatty alcohol can be attached to the sugar moiety to provide the desired hydrophobic group.

Sugar moieties include sucrose, galactose, mannose, glucose, fructose, sorbitan, sorbitol, mannitol, inositol, etc., and/or their derivatives such as glucosides, galactosides, etc. Other "sugar" types of moieties containing multiple hydroxy groups can also be used including starch fractions and polymers such as polyglycerols. The sugar moiety is any polyhydroxy group that provides the requisite number of hydroxy groups.

The hydrophobic group can be provided by attachment with an ester, ether, or other linkage that provides a stable compound. The hydrophobic group is preferably primarily straight chain, and preferably contains some unsaturation to provide additional antistatic benefits. Such hydrophobic groups and their sources are well known, and are described hereinafter with respect to the more conventional types of softening agents.

The polyalkoxy chain can be all ethoxy groups, and/or can contain other groups such as propoxy, glyceryl ether, etc., groups. In general, polyethoxy groups are preferred, but for improved properties such as biodegradability, glyceryl ether groups can be inserted. Typically there are from about 5 to about 100, preferably from about 10 to about 40, more preferably from about 15 to about 30, ethoxy groups, or their equivalents, per molecule.

An empirical formula is as follows:

$$R_m—(sugar)(R^1O)_n$$

wherein R is a hydrophobic group containing from about 8 to about 30, preferably from about 12 to about 22, more preferably from about 16 to about 18 carbon atoms; "sugar" refers to a polyhydroxy group, preferably derived from a sugar, sugar alcohol, or similar polyhydroxy compound; $R^1$ is an alkylene group, preferably ethylene or propylene, more preferably ethylene; m is a number from 1 to about 4, preferably 2; and n is a number from about 5 to about 100, preferably from about 10 to about 40. A preferred compound of this type is polyethoxylated sorbitan monostearate, e.g., Glycosperse S-20 from Lonza, which contains about 20 ethoxylate moieties per molecule.

The level of the polyethoxy sugar derivative is typically at least about 5%, preferably at least about 10%, more preferably at least about 15%. Preferably the maximum level is no more than about 90%, more preferably no more than about 75%.

The polyethoxy sugar derivative provides improved antistatic properties to the compositions and can provide equivalent antistatic properties to conventional dryer added compositions, and/or articles, even with less, or no, quaternary ammonium softener materials present. It is possible to prepare a dryer-added composition, or article, that is entirely nonionic.

Fabric softening compositions employed herein can also contain, as a preferred component, at a level of from about 0% to about 95%, preferably from about 10% to about 75%, more preferably from about 20% to about 60%, carboxylic acid salt of a tertiary amine that has the formula:

$$R^5—N(R^6)(R^7)—H^{(+)(-)}O—C(O)—R^8$$

wherein $R^5$ is a long chain aliphatic group containing from about 8 to about 30 carbon atoms; $R^6$ and $R^7$ are the same or different from each other and are selected from the group consisting of aliphatic groups containing from about 1 to about 30 carbon atoms, hydroxyalkyl groups of the Formula $R^4OH$ wherein $R^4$ is an alkylene group of from about 2 to about 30 carbon atoms, and alkyl ether groups of the formula $R^9O(C_nH_{2n}O)_m$ wherein $R^9$ is alkyl and alkenyl of from about 1 to about 30 carbon atoms and hydrogen, n is 2 or 3, and m is from about 1 to about 30, and wherein $R^8$ is selected from the group consisting of unsubstituted alkyl, alkenyl, aryl, alkaryl and aralkyl of about 1 to about 30 carbon atoms, and substituted alkyl, alkenyl, aryl, alkaryl, and aralkyl of from about 1 to about 30 carbon atoms wherein the substituents are selected from the group consisting of halogen, carboxyl, and hydroxyl, said composition having a melting point of from about 35° C. to about 100° C.

This component can provide the following benefits: superior odor, a decrease in paint softening of the dryer drum, and/or improved fabric softening performance, compared to similar articles without this component. Either $R^5$, $R^6$, $R^7$, and/or $R^8$ chains can contain unsaturation for improved antistatic benefits.

Tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates that build up as an undesirable residue on treated fabrics.

Preferably, $R^5$ is an aliphatic chain containing from about 12 to about 30 carbon atoms, $R^6$ is an aliphatic chain of from about 1 to about 30 carbon atoms, and $R^7$ is an aliphatic chain of from about 1 to about 30 carbon atoms. Particularly preferred tertiary amines for static control performance are those containing unsaturation; e.g., oleyldimethylamine and/or soft tallowdimethylamine.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleyl methylamine, lauryldi(3-hydroxypropyl)amine, stearyldi(2-hydroxyethyl)amine, trilaurylamine, laurylethylmethylamine, and $C_{18}H_{37}N[(OC_2H_4)_{10}OH]_2$.

Preferred fatty acids are those wherein $R^8$ is a long chain, unsubstituted alkyl or alkenyl group of from about 8 to about 30 carbon atoms, more preferably from about 11 to about 17 carbon atoms. Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl)acetic acid, and phthalic acid.

Preferred carboxylic acids are stearic, oleic, lauric, myristic, palmitic, and mixtures thereof The amine salt can be formed by a simple addition reaction, well known in the art, disclosed in U.S. Pat. No. 4,237,155, Kardouche, issued Dec. 2, 1980. Excessive levels of free amines may result in odor problems, and generally free amines provide poorer softening performance than the amine salts.

Preferred amine salts for use herein are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine palmitate, distearylmethylamine palmitate, distearylmethylamine laurate, and mixtures thereof A particularly preferred mixture is oleyldimethylamine stearate and distearylmethylamine myristate, in a ratio of 1:10 to 10:1, preferably about 1:1.

Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

(1) Optional Nonionic Softener

A highly preferred optional ingredient is a nonionic fabric softening agent/material. Typically, such nonionic fabric softener materials have an HLB of from about 2 to about 9, more typically from about 3 to about 7. In general, the materials selected should be relatively crystalline, higher melting, (e.g., >25° C.).

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. These nonionic fabric softening materials do not include the ethoxylated sugar derivatives disclosed hereinbefore. They typically contain no more than about 4 ethoxy groups per molecule.

The fatty acid portion of the ester is normally derived from fatty acids having from about 8 to about 30, preferably from about 16 to about 20, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 4 oxyethylene units, and mixtures thereof For the purpose of the present invention, sorbitan esters containing unsaturation (e.g., sorbitan monooleate) are preferred.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society*, Vol. 45, October 1968.

Details, including formula, of the preferred sorbitan esters can be found in U.S. Pat. No. 4,128,484, incorporated hereinbefore by reference.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetraesters are preferred.

The material that is sold commercially as sorbitan monoester (e.g., monostearate) does in fact contain significant amounts of di- and tri-esters and a typical analysis of commercial sorbitan monostearate indicates that it comprises about 27% mono-, 32% di- and 30% tri- and tetraesters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or diesters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated with no more than about 4 ethoxy groups per molecule to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono and/or diesters of the polyglycerol polyols are preferred, the fatty acyl groups typically being those described hereinbefore for the sorbitan and glycerol esters.

(3) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents that can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

(4) Cyclodextrin/Perfume Complexes and Free Perfume

The products herein can also contain from about 0.5% to about 60%, preferably from about 1% to about 50%, cyclodextrin/perfume inclusion complexes, as disclosed in U.S. Pat. Nos. 5,139,687, Borcher et al., issued Aug. 18, 1992; and 5,234,610, Gardlik et al., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that nonsubstantive perfumes are also effective. The volatility and substantivity of perfumes is disclosed in U.S. Pat. No. 5,234,610, supra.

If a product contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(5) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include ascorbic acid, ascorbic palmitate, propyl gallate, available from Eastman Chemical Products, Inc., under the trade names Tenox® PG and Tenox S-1; a mixture of BHT, BHA, propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

The stability of the compounds and compositions herein can be helped by the stabilizers, but in addition, the preparation of compounds used herein and the source of hydrophobic groups can be important. Surprisingly, some highly desirable, readily available sources of hydrophobic groups such as fatty acids from, e.g., tallow, possess odors that remain with the compound, e.g., DEQA despite the chemical and mechanical processing steps that convert the raw tallow to finished DEQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance.

(6) Other Optional Ingredients

The present invention can include other optional components (minor components) conventionally used in textile treatment compositions, for example, colorants, preservatives, optical brighteners, opacifiers, physical stabilizers such as guar gum and polyethylene glycol, anti-shrinkage agents, anti-wrinkle agents, fabric crisping agents, spotting agents, germicides, fungicides, anti-corrosion agents, antifoam agents, and the like.

(B) The Substrate

The present invention relates to articles of manufacture comprising a substrate that has been modified to provide superior feel and acceptability after use.

Representative articles and their components are those that are adapted to soften fabrics in an automatic laundry dryer, including the ones disclosed in U.S. Pat. Nos.: 5,470,492, Childs et al.,. issued Nov. 11, 1995; 3,989,631 Marsan, issued Nov. 2, 1976; 4,055,248, Marsan, issued Oct. 25, 1977; 4,073,996, Bedenk et al., issued Feb. 14, 1978; 4,022,938, Zaki et al., issued May 10, 1977; 4,764,289, Trinh, issued Aug. 16, 1988; 4,808,086, Evans et al., issued Feb. 28, 1989; 4,103,047, Zaki et al., issued July 25, 1978; 3,736,668, Dillarstone, issued Jun. 5, 1973; 3,701,202, Compa et al., issued Oct. 31,1972; 3,634,947, Furgal, issued Jan. 18, 1972; 3,633,538, Hoeflin, issued Jan. 11, 1972; and 3,435,537, Rumsey, issued Apr. 1, 1969; and 4,000,340, Murphy et al., issued Dec. 28, 1976, all of said patents being incorporated herein by reference.

The fabric treatment compositions are provided as an article of manufacture in combination with the flexible substrate as described hereinafter. The substrates herein effectively release the composition (A) in an automatic laundry (clothes) dryer.

The substrate dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

The substrates useful herein are polyester non-woven fabrics having basis weights of from about 0.53 oz/yd$^2$ to about 0.59 oz/yd$^2$, preferably from about 0.54 oz/yd$^2$ to about 0.58 oz/yd$^2$, more preferably from about 0.55 oz/yd$^2$ to about 0.57 oz/yd$^2$. These substrates are prepared using polyester fibers having deniers of from 5 to about 8, preferably from 5 to about 7, and more preferably about 6.

Surprisingly, the use of fibers having a denier of from 5 to about 8, while maintaining the same basis weight, provides more void volume and increases the substrate thickness, as compared to the use of fibers with lower deniers. This property had not previously been recognized. This unexpected property results in substrates with increased loft as compared to substrates produced using fibers with a denier of about 4 and with no loss of substrate strength. Typically, the fiber is a continuous filament that is laid down, in a pattern that results in a multiplicity of layers and intersections between overlaid portions of the filament, on a belt, preferably foraminous, and then the fiber intersections are fused into fiber-to-fiber bonds by a combination of heat and pressure, typically a temperature of about 237° C. and a roll pressure of about 40 lbs/sq-in. It had been discovered, that reducing the temperature to from about 237° C. to about 231° C., preferably to from about 237° C. to about 233° C., more preferably from about 237° C. to about 235° C. and/or pressure of from about 40 psig to about 10 psig, more preferably from about 10 psig to about 0 psig, also provided increased thickness (loft), a softer substrate, especially after use, increased fuzziness, especially on the belt side of the substrate, and no loss of strength or an actual improvement in strength. The conditions can be varied, but are adjusted to provide at least a 14% increase in thickness, more preferably at least a 30% increase in thickness, from about 0.14 mm for the standard conditions, to at least about 0.17 mm, more preferably at least about 0.20 mm. The fuzziness, as rated by a panel on a scale of from 1 to 5, where 1 is high fuzz, improves from about 4 to about 2.9 on the outside (non-belt or "jet" side where the air jets are located) and from about 4.4 to about 1.9 on the belt side of the substrate. In order for the polyester substrate to be rated significantly better than available substrates, the "belt fuzz" and "jet fuzz" grades should be from about 1.8 to about 3.3, preferably from about 2 to about 3, more preferably from about 2.2 to about 2.9.

The "fuzz" test uses a rubber bottom sled with a standard weight, approximately 1000 gm, which is pulled back and forth across a sample of the substrate. A standard sample of commercial substrate is assigned a fuzz value of 4 and the fuzz grades are assigned based on no fuzz being 0. The grading is visual. The test measures the tendency of the individual fibers to be loosened by moderate abrasion conditions. Grading of softness shows that the fuzz test predicts the softness of the substrate after use.

The typical polyester substrate used heretofore is significantly less soft after use than a rayon substrate whereas the polyester substrates herein, especially those formed with lower temperature and lower pressure are not significantly less soft than a commercial rayon substrate.

In addition to the above noted improvements in the physical characteristics, the breaking strengths remain at least about 3 lbs/sq-in in each direction. i.e., from about 3 to about 14, preferably from about 6 to about 12, more preferably from about 7 to about 9, lbs/sq-in. These substrates are fabricated from polyester fibers having a denier from 5 to about 8, preferably from 5 to about 7, more preferably about 6.

The fabrics are typically prepared by laying a thin layer of fiber in a random patern on a moving foraminous belt and then applying heat to melt at least a portion of the surfaces of the fibers and applying heat and pressure to fuse the adjacent fibers to each other at their intersections. The amount of heat and pressure is adjusted to provide the desired bonding.

Usage

The articles of this invention can be used for imparting the fabric treatment composition to fabric (clothes) to provide softening and/or antistatic effects to fabric in an automatic laundry dryer. Generally, the method of using the articles of the present invention comprises: commingling pieces of damp fabric by tumbling said fabric under heat in an automatic clothes dryer with an article comprising an effective amount of composition (A). The composition should have a melting point greater than about 35° C. and be flowable at dryer operating temperature.

The present invention relates to improved solid dryer-activated fabric softener articles that have improved acceptability to the consumer.

All percentages, ratios, and parts herein, in the Specification, Examples, and Claims, are by weight and are approximations unless otherwise stated.

The following are nonlimiting examples of the instant articles, methods, and compositions of the present invention.

EXAMPLE 1

| Components | Wt. % |
|---|---|
| Ditallowdimethylammonium sulfate | 21.04 |
| Stearyldimethylamine Stearic Acid Salt* | 32.83 |
| Perfume/Cyclodextrin Complex | 19.36 |
| Clay** | 3.79 |
| Perfume | 1.56 |
| Sodium $C_{12}$ Alkylbenzene Sulfonate | 0.38 |
| Sorbitan Monostearate | 21.04 |
| | 100.0 |

*1:2 ratio of stearyldimethylamine:triple-pressed stearic acid.
**Calcium bentonite clay, Bentolite L, sold by Southern Clay Products, or Gelwhite GP clay.

PREPARATION OF THE SUBSTRATE

The substrate was prepared in a conventional manner with the changes being in the bonding temperature (from about 237° C. to about 235° C.) and the consolidating pressures (from about 40 psig to about 0 psig for the nip roll and from about 10 psig to about 4.5 psig for the consolidation roll steam pressure) and denier from 4 dpf to 6 dpf The substrate prepared by the conventional process compares to the improved substrate as follows: Denier 4 versus 6, Fuzz rating (1 to 5 grade with 1 being most preferred) Jet Fuzz 4.0 vs. 2.9 and Belt side Fuzz 4.4 vs. 1.9; Tearing tensile strength (lbs/in) cross direction 3.3 vs. 5.7 and machine direction 3.7 vs. 4.5; Softness vs. Rayon (−4 to +4 grade with positive numbers indicating a preference) 2.79 (significantly worse) vs. −0.58 (not significantly different).

PREPARATION OF FABRIC CONDITIONING SHEETS

The coating mixture is applied to the said improved substrate sheets (22.86 cm. by 22.86 cm., about 523 sq.cm. having a weight of about 1 gm) The substrate sheets are comprised of about 6-denier spun bonded polyester. The molten fabric conditioning composition is applied with an impregnation head and drawn between two heated rollers to impregnate the substrate and remove excess composition. The softener composition is applied in an amount of about 2.38 gm per sheet. When the sheets (articles) are used by consumers, they are preferred for softness as compared to sheets prepared with existing substrates and are not significantly different from prior art rayon substrate articles.

EXAMPLE 2

| Components | Wt. % |
|---|---|
| Ditallowdimethylammonium sulfate | 21.04 |
| Stearyldimethylamine Stearic Acid Salt* | 32.83 |
| Perfume/Cyclodextrin Complex | 19.36 |
| Clay** | 3.79 |
| Perfume | 1.56 |
| Sodium $C_{12}$ Alkylbenzene Sulfonate | 0.38 |
| Sorbitan Monostearate | 21.04 |
| | 100.0 |

*1:2 ratio of stearyldimethylamine:triple-pressed stearic acid.
**Calcium bentonite clay, Bentolite L, sold by Southern Clay Products, or Gelwhite GP clay.

PREPARATION OF THE SUBSTRATE

The substrate was prepared in a conventional manner with the only changes being in the bonding temperature (from about 237° C. to about 235° C.) and the consolidating pressures (from about 40 psig to about 0 psig for the nip roll and from about 10 psig to about 4.5 psig for the consolidation roll steam pressure) and a denier change from 4 to 6 denier per fiber (dpf). The substrate prepared by the conventional process compares to the improved substrate as follows: Denier 4 versus 6, Fuzz rating (1 to 5 grade with 1 being most preferred) Jet Fuzz 4.0 vs. 2.9 and Belt side Fuzz 4.4 vs. 1.9; Tearing tensile strength (lbs/in) cross direction 3.3 vs. 5.7 and machine direction 3.7 vs. 4.5; Softness vs. Rayon (−4 to +4 grade with positive numbers indicating a preference) −2.79 (significantly worse) vs. −0.58 (not significantly different).

PREPARATION OF FABRIC CONDITIONING SHEETS

The coating mixture is applied to the said improved substrate sheets (22.86 cm. by 22.86 cm., about 523 sq.cm. having a weight of about 1 gm) The substrate sheets are comprised of about 6-denier spun bonded polyester. The molten fabric conditioning composition is applied with an impregnation head and drawn between two heated rollers to impregnate the substrate and remove excess composition. The softener composition is applied in an amount of about 2.38 gm per sheet. When the sheets (articles) are used by consumers, they are preferred for softness as compared to sheets prepared with existing substrates and are not significantly different from prior art rayon substrate articles.

Example 3

Fabric conditioning sheets are prepared according to Example 2 with the improved substrate sheets and compared after use to other commercial sheets having combined (average) belt and fuzz grades of from about 3 to about 3.5. The improved substrate sheets had average softness grades of about 1.16 versus average softness grades of about 2.24 for the commercial sheets. A difference of about 1 being consumer noticeable.

What is claimed is:

1. A dryer-activated fabric conditioning article comprising:

(A) at least about 5% of fabric conditioning composition comprising fabric conditioning active; and (B) a polyester non-woven fabric substrate prepared from a polyester fiber having a denier of from 6 to about 8, said substrate having a basis weight of from about 0.53 oz/yd$^2$ to about 0.59 oz/yd$^2$, and a thickness of from about 0.16 mm to about 0.23 mm.

2. The article of claim 1 wherein, component (B) is prepared from fibers having a denier of from 6 to about 7.

3. The article of claim 2 wherein, there is from about 15% to about 55% of (A).

4. The article of claim 3 wherein said substrate has a thickness of from about 0.19 mm to about 0.21 mm and a tear strength of at least about 3 lbs/in$^2$ in both the cross direction and the machine direction.

5. The article of claim 1 containing an amine salt selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine laurate, distearylmethylamine oleate, and mixtures thereof.

6. The article of claim 5 wherein the amine salt comprises a mixture of oleyldimethylamine stearate and distearylmethylamine myristate in a weight ratio of from 1:10 to 10:1.

7. A dryer-activated fabric conditioning article comprising:

(A) from about 15% to about 55% of fabric conditioning composition comprising fabric conditioning active; and (B) a polyester non-woven fabric substrate prepared from a polyester fiber having a denier of from 6 to about 8, said substrate having a basis weight of from about 0.53 oz/yd$^2$ to about 0.59 oz/yd$^2$, a thickness of from about 0.16 mm to about 0.23 mm and a tear strength of from about 4 to about 7 lbs/in$^2$ in the cross direction and from about 3.1 to about 6 lbs/in$^2$ in the machine direction.

8. The article of claim 7 wherein, component (B) is prepared from fibers having a denier of 6 to about 7.

9. The process of using the article of claim 1 in an automatic laundry dryer to condition fabrics.

10. The process of using the article of claim 7 in an automatic laundry dryer to condition fabrics.

11. The article of claim 2 wherein the polyester nonwoven fabric substrate has jet side and belt side fuzz grades of from about 1.8 to about 2.9.

12. The article of claim 8 wherein the polyester nonwoven fabric substrate has jet side and belt side fuzz grades of from about 2.2 to about 2.5.

* * * * *